US006557854B1

(12) United States Patent
Jaspers

(10) Patent No.: US 6,557,854 B1
(45) Date of Patent: May 6, 2003

(54) METHOD OF PLAYING A WORD FORMING BOARD GAME

(76) Inventor: Richard L. Jaspers, 3325 Virginia Way, Longview, WA (US) 98632

( * ) Notice: Subject to any disclaimer, the term of this patent is extended or adjusted under 35 U.S.C. 154(b) by 147 days.

(21) Appl. No.: 09/715,709

(22) Filed: Nov. 20, 2000

(51) Int. Cl.[7] ..... A63F 3/00
(52) U.S. Cl. ..... 273/272; 273/146
(58) Field of Search ..... 273/272, 299, 273/240, 146, 292, 157 R

(56) References Cited

U.S. PATENT DOCUMENTS

| | | | | |
|---|---|---|---|---|
| 3,195,893 | A | | 7/1965 | Friedman |
| 3,195,895 | A | * | 7/1965 | Kropinski |
| 3,472,514 | A | | 10/1969 | Green |
| 4,340,231 | A | * | 7/1982 | Cammarata |
| 4,448,423 | A | | 5/1984 | Augusta |
| 4,923,199 | A | * | 5/1990 | Hahn |
| 5,139,271 | A | | 8/1992 | Bez |
| 5,149,103 | A | | 9/1992 | Ross |
| 5,324,040 | A | | 6/1994 | Panda |
| 5,374,065 | A | | 12/1994 | Motskin |
| 5,429,371 | A | * | 7/1995 | Bledsoe |
| 6,116,604 | A | * | 9/2000 | Vandelli |

* cited by examiner

*Primary Examiner*—William M. Pierce

(57) ABSTRACT

A method of playing a word forming board game upon an erasable surface (10), divided into rectangular letter spaces (14) by grid lines (11 and 12). In turn each player adds letters to spell a word. This primary word must extend from the previously played letters of the game. A die roll and an instruction card (19) determine the number of letters to be added. A player receives a point for each letter of the primary word, including letters extending from previous play. Additionally, the player receives a point for each letter of any other acceptable words formed during play, such as words within words. Acceptable words must read from left to right without skipping letters and must also be at least three letters long. Further, the words must be acceptable in respect to the word types as defined by the rules. Allowances are made for word challenging. The game proceeds until someone has reached a predetermined number of points.

10 Claims, 3 Drawing Sheets

METHOD OF PLAYING A WORD FORMING BOARD GAME

CROSS-REFERENCE TO RELATED APPLICATIONS

Not applicable.

BACKGROUND—FIELD OF INVENTION

The present invention relates to a word forming board game, specifically to forming words extending from previously played letters of a word chain and including words within words.

BACKGROUND—REVIEW OF PRIOR ART

The prior art includes many types of word forming board games. A small number of these games employ the concepts of word chains, word extending, and word extracting. Prior art in these areas include games which construct multidirectional word bridges across a board, games which allow for the addition of letters to each end of a word to create an entirely new word (embedding), and games in which known words are extracted from provided words. Prior art suffers from a number of disadvantages:

(a) Their methods of play and scoring systems do not reward word selection which creates multiple words within words in a single turn.

(b) These games do not allow for the extension of words from multiple letters of previous play in a word chain.

(c) These games do not provide a method of scoring which rewards both the number of words and the length of each word in a given turn.

(d) They do not provide a method of board rotation or movement without resorting to complex board design (for games with only one word orientation, the board must be rotated to face each player in turn). Tiles tend to easily move off their space during play.

(e) Some of these games require the need for selector holders to hide and sort a specified number of tiles. These devices not only add to the cost of the game, but also indicate a limitation of available letter choices for play.

(f) In games which have no limitation on letter choice, the methods for letter selection are cumbersome and time consuming. In these games, clean up or set up times are also longer because letters have to be sorted and regrouped. There is also a possibility of running out of specific letters if an overabundance of each letter is not supplied.

SUMMARY

The present invention is a word forming board game played upon an erasable surface. The game board is divided into letter spaces. In turn each player rolls a die to determine the maximum amount of letters to be played. An instruction card is then drawn. This card may change play in some way. The active player then declares a word and adds the letters to spell this word. This primary word must extend from the previously played letters of a word chain. Players receive one point for every letter in their primary word, and all other acceptable words formed during play. Acceptable words must read from left to right without skipping letters. They must also be at least three letters long. Other players may challenge any words they believe to be misspelled or otherwise unacceptable according to the rules. The game proceeds until someone has reached a predetermined number of points.

OBJECTS AND ADVANTAGES

Accordingly, several objects and advantages to the present invention are:

(a) to provide a style of play with the unique purpose of creating multiple words within words during a single turn.

(b) to provide a means of extending new words from multiple letters of previous play in a word chain.

(c) to provide a method of play which allows for the rotation of the playing surface and keeps letters from moving without complex board design or excessive cost.

(d) to provide a method of play which precludes the need for selector holders to hide and sort tiles.

(e) to provide an improved method of selecting and playing letters in a game with no limitation on letter choice.

The present invention and its obvious advantages will be best understood from the following description of the specific embodiments when read with the accompanying drawings.

DESCRIPTION OF DRAWINGS

The present invention will be better understood by consideration of the detailed description that follows. The description will make references to these figures and their elements.

REFERENCE NUMERALS IN DRAWINGS

Figure 1:
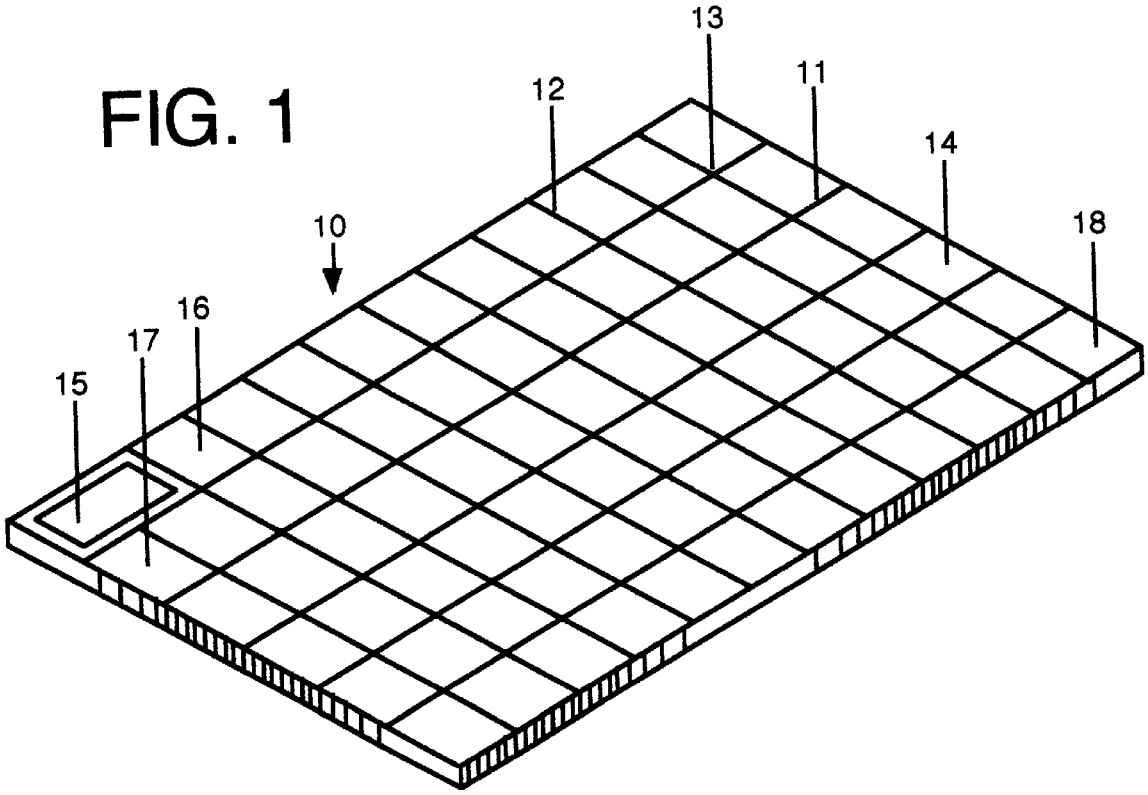
FIG. 1 is a perspective view of the game board.

10 Rigid erasable board
11 Horizontal lines
12 Vertical lines
13 Grid
14 Letter rectangles
15 Logo sticker (Optional)
16 Starting space
17 First space of row two
18 Last board space
19 Instruction cards
20 Take normal turn cards
21 Add one letter to die roll card
22 Add two letter to die roll card
23 Double point card
24 Double turn card
25 Skip turn card
26 Free letter card
27 Steal turn card
28 Extend card
29 Score sheet
30 Name Box
31 Letter box
32 Word totals column
33 Accumulated game totals column

DETAILED DESCRIPTION OF THE PREFERRED EMBODIMENTS

FIG. 1 shows a perspective view of the playing surface. A rigid erasable board 10 consists of a material for use with dry erase markers or a similar erasure system. The surface of board 10 is divided by horizontal lines 11 which intersect vertical lines 12 to form a grid 13. This grid is produced by silkscreening or any method which will permanently adhere or etch lines 11 and 12 to board 10. Grid 13 creates letter rectangles 14 of uniform size. The first two letter rectangles may be dedicated to the placement of a logo sticker 15. During play board 10 will have a horizontal orientation and each letter rectangle will have a vertical orientation. A starting space 16 is the beginning point of each game. A first space of row two 17 is considered a continuation of the last space in row one 18.

Figure 2:
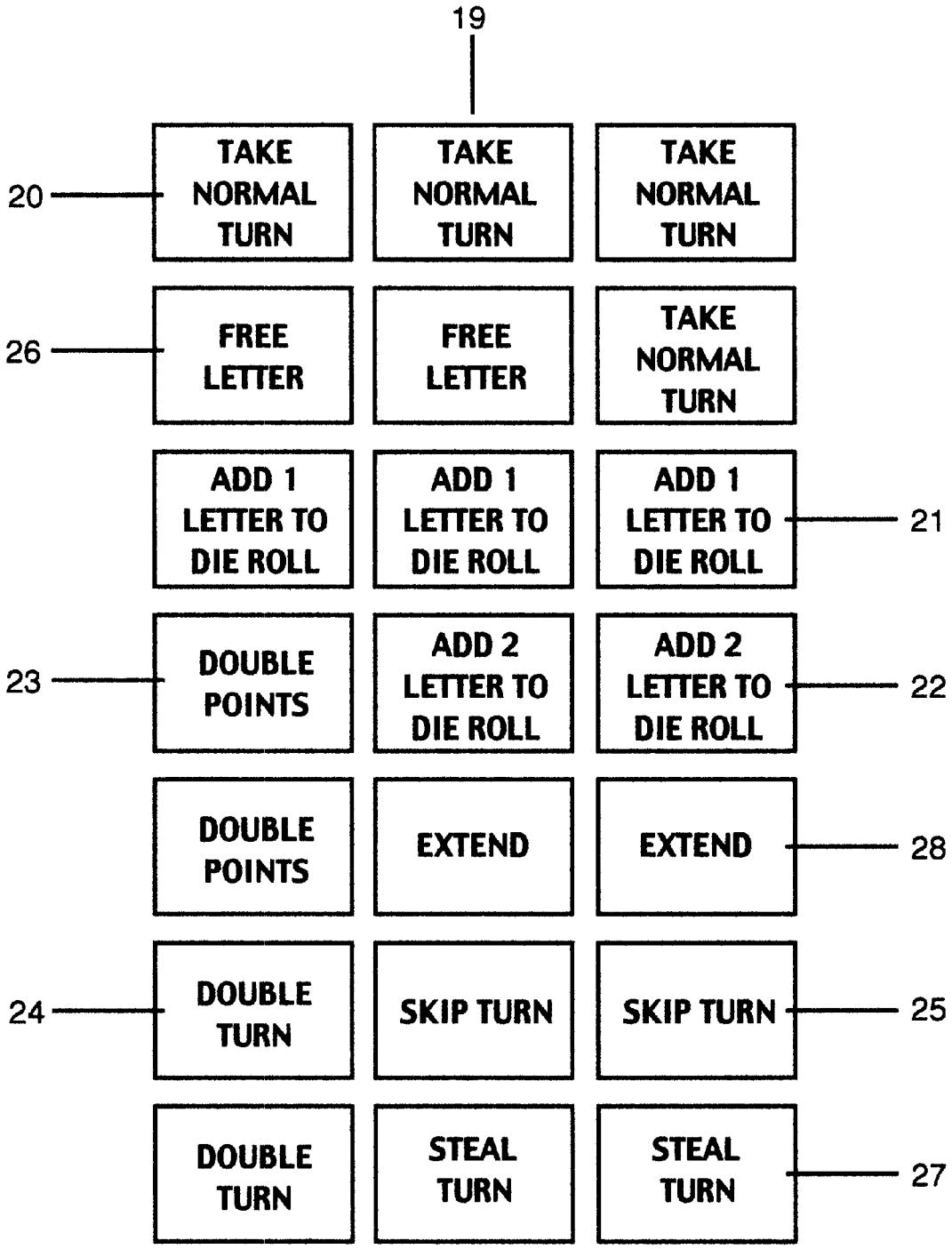
FIG. 2 shows a complete set of instruction cards including all duplicates.

FIG. 2 shows a complete set of instruction cards 19 including the quantity of each provided. There are a total of 21 cards 19. Each instruction card 19 will be offset printed on one side, on index or cover stock with the dimensions of 8.9 cm (3.5 inches) by 6 cm (2.375 inches) or of similar size determined by the parent sheet size of the chosen stock. Following is a list of the instruction cards proceeded by the quantity of each in a full deck:

4-Take normal turn cards 20

3-Add one letter to die roll cards 21

2-Add two letters to die roll cards 22

2-Double points cards 23

2-Double turn cards 24

2-Skip turn cards 25

2-Free letter cards 26

2-Steal turn card 27

2-Extend cards 28

All cards will be blank on the back side or will contain a printed logo.

Figure 3:
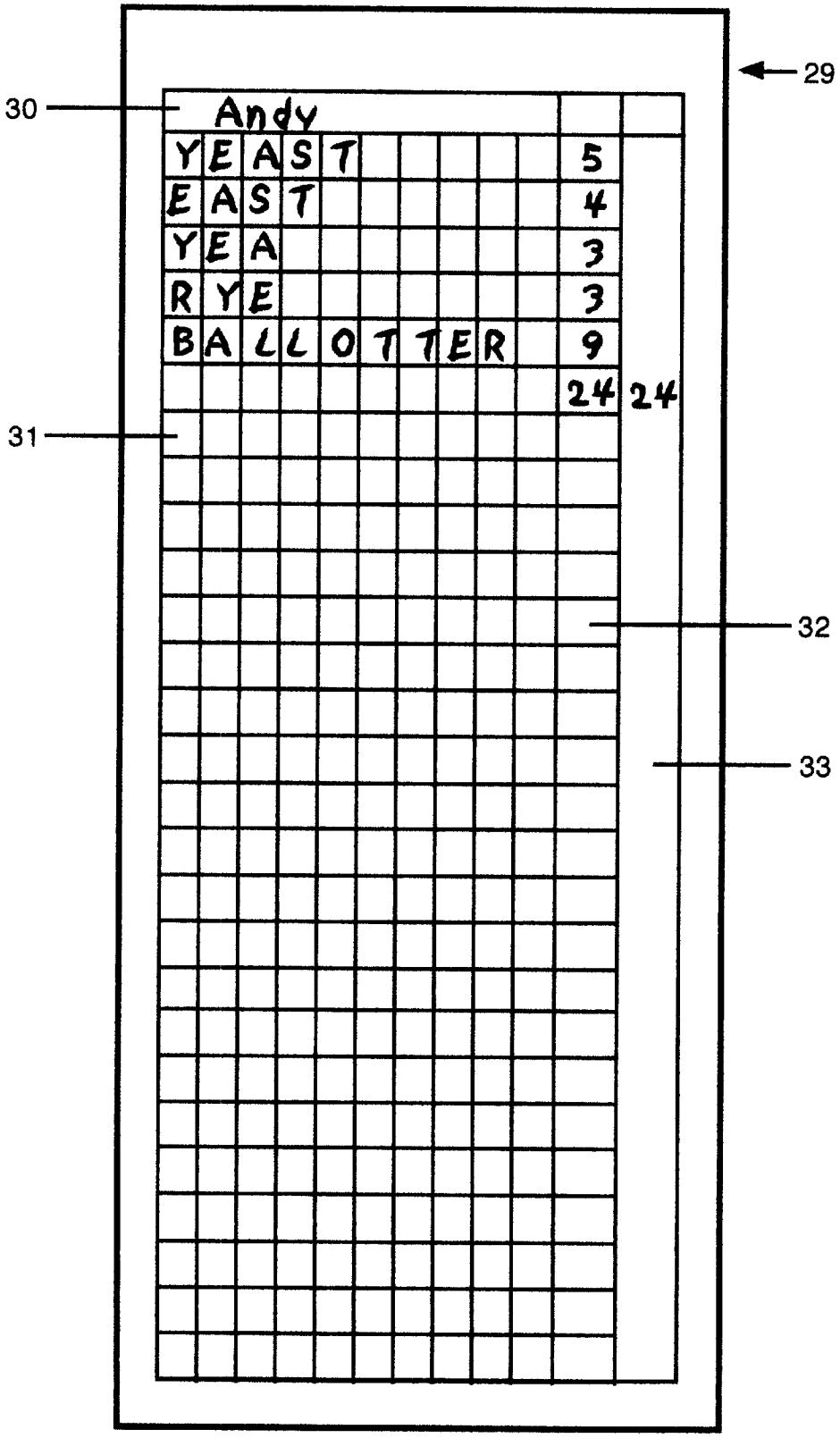
FIG. 3 is a plan view of a score sheet, showing its elements and an example of a player's score for a single turn.

FIG. 3 is a plan view of a score sheet 29. Score sheet 29 will be 21.6 cm (8.5 inches) by 9.2 cm (3.63 inches). The score sheet will be printed on either one or both sides with black ink on twenty 20# white bond. The score sheets will be padded at the top in quantities of 25, with a total of four pads provided. Score sheet 29 consists of a name box 30, a gridded section of letter boxes 31, a word totals column 32 and an accumulative game totals column 33.

Game elements not described or numbered because of of familiarity are a standard six sided numerical die (a random selector), dry erase marker, wipe cloth, and pencils (for score keeping). Additionally, a complimentary 3-up score sheet with a size of 21.6 cm (8.5 inches) by 27.9 cm (eleven inches) may be provided for photocopying when the score sheets run out.

OPERATION OF PREFERRED EMBODIMENTS (RULES)

In this game players form words extending from previously played letters of a word chain. Points are awarded for all acceptable words of three letters or more formed during play, including words within words (the word orange also contains the words range, rang and ran).

To set up, instruction cards 19 are to be shuffled and placed face down in a location easily accessible to all players.

To start the game, each player roles a six sided numerical die (hereafter stated only as die). The player with the highest die role begins and play proceeds clockwise. The player to the right of the starter picks a letter and writes it on starting space 16. Any letter except X may be chosen. The active player rolls the die to determine the number of letters to be played.

The active player then draws instruction card 19 from the top of the deck of cards. The instruction card may change play in some way. Take normal turn card 20 allows the active player to add only the number of letters indicated by the die roll. Add one letter to die roll card 21 gives the player an additional letter beyond the quantity of letters indicated by the die roll. Add two letters to die roll card 22 gives a maximum of two additional letters. Double point card 23 doubles a players point total for one turn. Double turn card 24 allows a player to play two consecutive turns. When this card is drawn the player must reroll the die and draw another instruction card for the second turn. Skip turn card 25 means the player loses his turn and the die roll is disregarded. Free letter card 26 can be used on the current turn as an additional letter for play, or it may be kept by the player and used on any subsequent turn during the game. Steal turn card 27 gives a nonactive player the opportunity to play out of the normal clockwise order for one turn. The player keeps this card until they desire to use it. The player must state that they are using the steal card before the active player has begun to add letters to the board. This card does not give a player an extra turn because they miss their regular turn for that round. It does, however give the card holder an opportunity to to play when they see a chance for a high point total. When stealing a turn the player does not use the die roll and instruction card of the player whose turn they stole. They roll the die and draw instruction card 19 of their own. The player whose turn was stolen plays a normal turn directly after the thief, and the thief misses their normal turn for that round. The steal turn card and the free letter card are the only cards which may be kept and used later in the game. A player may use extend card 28 to form a word of any length regardless of the die roll, however it must include at least the last two letters of the previous word.

If a player rolls a one with the die, the player may draw instruction card 19 and take a normal turn or this player may roll the die again and receive the square of the die roll as the point total for that turn.

| Roll of die | 1 | 2 | 3 | 4 | 5 | 6 |
|---|---|---|---|---|---|---|
| Square of die roll | 1 | 4 | 9 | 16 | 25 | 36 |

Refer to the preceding chart for point totals derived from the die rolls. For example, a die roll of five would yield a point total of twenty five.

An active player may score in four different ways:

(a) Primary Words—On each turn the active player writes down letters to spell out a primary word. This word must have at least three letters including the last letter of the previous word, and be an acceptable word according to the rules. The primary word may extend from further in the word chain than one letter, but it must contain at least the last letter of the previous word. A player can only play one primary word per turn.

(b) Secondary Words—A player will also receive points for any acceptable words contained within the primary word.

(c) Adjoining Words—Words created as a result of a players new letters but not entirely contained within the primary word.

(d) Undiscovered Words—Words created from previous play but not discovered by other players during their turn. An undiscovered word may only be claimed by the active player.

A player receives one point for each letter in each word of the four types described above. All words must read from left to right without skipping letters to have point value. The first letter in each row is a continuation of the row above. It is not necessary to use the full number of letters available, however extra letters do not carry over to the next turn. If a player is unable to play, the player may skip their turn without penalty. If all players are unable to play off a particular word, the original player to skip their turn will play off a new letter selected by the player to this player's right, and written to the right of the last letter played on the board. Play may start with this new letter, or may extend from further into the word chain if possible.

Acceptable Words—All words of three or more letters are acceptable with the exception of foreign words, proper nouns, abbreviations, plurals created by adding only an "s", or words spelled with apostrophes or hyphens.

Each new game begins on starting space 16. The starting space is the leftmost letter rectangle on the top row of the board. Play proceeds from left to right to the end of the first row. A first space of row two 17 is a continuation of the first row. Each row is played from left to right and continues on the left side of the row below it. A last board space 18 is continued on starting space if necessary.

To illustrate the manner of play, the following example is given, showing the first round of a four player game.

As in the start of every game, the player to the right of the starter picks the starting letter. In this example the letter B is picked, and is written on starting space 16. The first player rolls a three and draws the instruction card which says "Add two to die roll". This gives the starting player a maximum of five letters to add to the starting letter already in place. The starter writes the letters ALLOT to the right of the starting letter B to form the primary word BALLOT. The secondary words found within the primary word BALLOT are BALL, LOT, ALL, and ALLOT. Counting each letter in the primary word and each letter of all secondary words gives the first player 21 points.

First Player:
Beginning letter: B
Roll of die: 3
Instruction card: Add 2 to die roll
BALLOT
Primary Word: BALLOT-6
Secondary Words: BALL-3
LOT-3
ALL-3
ALLOT-5
Total 21

The second player in this example rolls a four with the instruction card stating "double points". The second player adds the letters TERY to to the right of the letters already in place from the first player to form the primary word LOTTERY. The secondary word OTTER is contained within the primary word. This player also finds the adjoining word ALLOTTER which was formed by play but not completely contained within the primary word. Adding the letters in the primary, secondary, and adjoining words this player receives 20 points. The instruction card changes the score to 40 points.

Second Player
Roll of die: 4
Instruction card: Double Points
BALLOTTERY
Primary Word: LOTTERY-7

-continued

Secondary Word: OTTER-5
Adjoining Word: ALLOTTER-8
Total-20
(2X) 40

The third player rolls a four. The instruction card says "Take normal turn". The third player adds the letters EAST to form the primary word YEAST. Secondary words include EAST and YEA. The adjoining word RYE is also formed. The third player also spots the undiscovered word BALLOTTER which was overlooked by the second player. The third player in this example has found all four types of scoring words in a single turn; primary, secondary, adjoining and undiscovered. The third player receives a total of 24 points.

Third Player:
Poll of die: 4
Instruction card: Take normal turn
BALLOTTERYEA
ST
Primary Word: YEAST-5
Secondary Words: EAST-4
YEA-3
Adjoining Word: RYE-3
Undiscovered Word: BALLOTTER-9
Total-24

The fourth player rolls a two and the instruction card says "Extend" which means a primary word of any length may be chosen, but it must extend from at least two letters of previous play. The roll of the die is ignored in this situation. The player writes the letters EREOMICROSCOPE for The primary word STEREOMICROSCOPE. Secondary words are MICROSCOPE, STEREO, SCOPE, COPE, and COP. Adjoining words are EASTER and ASTER. The fourth player receives a total of 55 points.

Fourth Player:
Roll of die: 2
Instruction card: EXTEND
BALLOTTERYEA
STEREOMICROS
COPE
Primary Word: STEREOMICROSCOPE-16
Secondary Words: MICROSCOPE-10
STEREO-6
SCOPE-5
COPE-4
COP-3
Adjoining Words: EASTER-6
ASTER-5
Total-55

Any word which is claimed for points may be challenged, but only a challenge of a primary word will result in the forfeiture of a player's turn. Consult a dictionary to resolve a challenge. If a primary word is challenged and is found to not exist, is spelled incorrectly or is unacceptable according to the rules, the active player loses their current turn. This player must remove their added letters. If the primary word is found to be correct then the challenger loses their next turn. If any word except the primary word is challenged no player will lose their turn regardless of the dictionary search. However the active player may not count points for any challenged word which is found to be incorrect. If the challenged word is correct the challenger losses one point for every letter of the challenged word. All challenges must occur before the next player rolls the die. If the players chose they may abandon the challenging system to provide for a more friendly game. In this style of play, the active player may even ask other players for assistance with spelling and acceptability of words.

A reasonable amount of time should be given to each player on their turn. The group of players decides before starting the game what the time limit will be. The players should set a limit which allows adequate time to come up with a word, yet keeps the game moving at a good pace. For official tournament play the time limit is set at two minutes per turn. When a person selects double turn card 24, the timer starts over for this players second turn. The time starts with the rolling of the die and the player must write a primary word and declare it before time runs out. If no primary word is chosen and declared in the allowed time, the player loses their turn. A reasonable amount of additional time is given for declaration of other words claimed for points and for score keeping. The declaration of each word allows opponents a chance to challenge any word they wish. If the players wish they may play with no time limit or use a time limit as a guide only, without the possibility of losing their turn if time runs out.

Each player keeps their own score on score sheet 29 provided. After writing the primary word on board 10, the player states the primary word, and writes it on the first available row of letter boxes 31 of the score sheet. The player then declares all other words of point value and writes them on separate consecutive rows of the score sheet with one letter per letter box. Longer words may require a second row of letter boxes 31. The player counts the total number of letters in each word, and writes the word totals in word totals column 32 to the right of each word. The total for a given turn is written in the word totals column under the last word total. This number must be stated when calculated. This total is then added to any previous turn totals in accumulative game totals column 33 directly to the right of each turn total calculated. FIG. 3 illustrates a filled in score sheet 29 for the first turn of the third player in the sample of play previously described.

Ending the game varies with the number of players. For two or three players, the game ends when all letter rectangles 14 on the board are filled. The player with the most points is the winner. For four or more players, the first player with 100 points is the winner. When the board is nearly filled, the top four rows are erased and play continues with starting space 16 once the bottom of board 10 is filled up. Once the first two rows are again filled in the rest of the bottom of the board may be erased to make room for additional play if needed. This continues until a player reaches 100 points. Team play progresses as in individual play except that team members assist each other to come up with words of the highest point value. In solitaire, a single player may play according to the rules for two to three players, picking their own starting letter, and trying to beat their own personal best score, filling in the entire board with letters.

CONCLUSION

Thus the reader will see that the game of this invention provides a unique yet challenging method for word forming. While a preferred embodiment has been shown and described, various modifications may be made without departing from the spirit and scope of the invention. Accordingly, the exact construction and operation have been described for the purpose of illustration rather than limitation. Many other variations are possible. For example:

(a) A no die and no instruction card 19 option. In this style of play, players are allowed to add a set number of letters on each turn without the use of a die or instruction card 19. This option takes away some of the element of chance.

(b) The list of acceptable word types may vary by either adding or subtracting restrictions to the current rules.

(c) A rule change or option of play may be considered which allows for the skipping of letters in word formation. Words would still have to read from left to right in this type of play.

(d) There may be a travel version of reduced size in which the playing surface and score sheet are incorporated onto a single sheet of paper. This version would be padded and each sheet would be discarded after use. In this game version there would be no die or instruction cards 19. Each player would be able to add a maximum of five new letters on a given turn.

(e) A computer or electronic game version may be considered using the same basic rules as the standard version, with adaptations necessary for digital gaming. This version would contain modes for solitaire, two player, multiple player, and computer players with multiple skill levels. It may also feature an on-line play mode.

(f) A category version or option in which all primary words relate to a defined topic. For example a geography game would limit the primary word list to countries, states, cities, rivers, mountains and other landmarks. In this example the rules would be altered to allow for proper names. In a category game the rules would also be changed to allow for the use of unlimited letters for each primary word. This would include the omission of the die and some or all of the instruction cards.

(g) A junior version would include a simplified set of rules with emphasis on building vocabulary skills.

Thus the spirit and scope of the invention should be determined by the appended claims, rather than by the embodiments illustrated.

I claim:

1. A method of playing a word forming game, wherein the improvement comprises formation of a single continuous word chain by an addition of a letter or letters by each player in turn, in a single linear direction to form a primary word, which must extend from at least a last letter of previous play, and may extend from multiple letters of said word chain, thereby rewarding a player with points for each letter within said primary word, as well as each letter of secondary, adjoining, and undiscovered words of previous play found by a current player, with all letters of the alphabet having equal value, and a random selector such as a die to be used in determining a maximum number of said letters to be added on a given turn.

2. A method according to claim 1 comprising the steps of:

a) rolling said die to determine the number of said letters to be played;

b) drawing an instruction card to determine changes in play;

c) adding said letters to said word chain to spell said primary word; and d) declaring and recording point totals for said primary word, said secondary words, said adjoining words, and said undiscovered words.

3. A method according to claim 1 wherein the playing surface is an erasable board divided into letter spaces, and play begins on a starting space located on the upper left corner of the game board, proceeding from left to right along a first row to a last letter space on said first row, continuing to the first said space of the second row, again proceeding from left to right, and following this procedure on said rows below, in the same fashion as reading a book.

4. A method according to claim 1 wherein an instruction card is drawn on each turn which changes play according to the directions thereon, and a quantity of said instruction cards allowing for the addition of an unlimited letter quantity to form said primary word.

5. An apparatus according to claim 1 comprising:

a) said erasable board divided into a plurality of said letter spaces;

b) a random selection device such as said die;

c) a set of game instructions;

d) a multitude of score sheets;

e) a plurality of instruction cards;

f) a dry erase or similar marker; and g) a wipe cloth.

6. A method according to claim 1 wherein challenges may be used when opponents question the validity of said words.

7. A method of playing a word forming game comprising the steps of:

a) rolling a die to determine a number of letters to be played;

b) drawing an instruction card to determine any changes in play;

c) adding said letters to a word chain to spell a primary word with the restriction that said primary word must extend from at least a last letter of previous play and may extend from multiple letters of said word chain; and d) declaring and recording point totals for said primary word, as well as each said words formed during play contained within said primary word, and further including any said words formed as the result of play but not contained entirely within said primary word, as well as said letters of previous play found by an active player without being recorded by previous play.

8. A method according to claim 7 wherein, there is no limitation to what letters of the alphabet may be used in play.

9. An apparatus according to claim 7 comprising:

a) an erasable board divided into a plurality of letter spaces;

b) a random selection device such as said die;

c) a set of game instructions;

d) a multitude of score sheets;

e) a plurality of said instruction cards;

f) a dry erase or similar marker; and g) a wipe cloth.

10. A method according to claim 7 wherein all letters of the alphabet have an equal point value.

* * * * *